United States Patent [19]

Weber

[11] 4,442,631

[45] Apr. 17, 1984

[54] LOCK FOR GARAGE DOOR EQUIPPED WITH AUTOMATIC GARAGE DOOR OPENER

[76] Inventor: Harvey L. Weber, 123 W. Wilken Way, Anaheim, Calif. 92802

[21] Appl. No.: 389,714

[22] Filed: Jun. 18, 1982

[51] Int. Cl.[3] ..... E05F 11/00

[52] U.S. Cl. ..... 49/199; 49/200

[58] Field of Search ..... 49/199, 19 D, 200; 160/192, 188, 207

[56] References Cited

U.S. PATENT DOCUMENTS

| | | | |
|---|---|---|---|
| 2,545,775 | 3/1951 | Hall | 49/197 |
| 2,708,478 | 5/1955 | Wolf et al. | 160/201 |
| 2,757,031 | 7/1956 | Levin | 292/5 |
| 3,224,492 | 12/1965 | Houk | 160/207 X |
| 3,704,548 | 12/1972 | Wiegleb | 49/199 |
| 3,909,980 | 10/1975 | Courtney et al. | 49/199 |
| 4,026,343 | 5/1977 | James | 160/207 X |

*Primary Examiner*—Philip C. Kannan

*Attorney, Agent, or Firm*—K. H. Boswell; Edward D. O'Brian

[57] ABSTRACT

A lock for use with a garage door having an automatic garage door opener attached thereto includes a housing which attaches to the garage door. A bracket attaches to the inside of the garage and is positioned such that the housing and the bracket are in close proximity to each other when the garage door is closed. An element is movably mounted on the housing to move between a locked and unlocked position. The automatic garage door opener attaches to the element and is capable of moving both the element between its locked and unlocked positions and moving the garage door via motion imparted to the door via the housing and the element. When the garage door is closed and the element is moved from its unlocked to its locked position the garage door is securely locked against being opened by an outside influence. An element positioning member is associated with the element and functions with the element such that when the garage door is closed and locked and the automatic garage door opener is activated, the automatic garage door opener first moves the element from its locked to its unlocked position and in further movement moves the garage from its closed to its open position. Upon reversal, the automatic garage door opener first moves the garage door from its open to its closed position and then subsequently moves the element from its unlocked to its locked position such that the element interacts with the bracket means to securely lock the garage door.

12 Claims, 5 Drawing Figures

LOCK FOR GARAGE DOOR EQUIPPED WITH AUTOMATIC GARAGE DOOR OPENER

BACKGROUND OF THE INVENTION

This invention is directed to a locking device to be used in combination with an automatic garage door opener to securely lock the garage door against entry therein. More specifically, the invention is directed to an element which works in conjunction with the automatic garage door opener to lock against a bracket and to also transfer movment of the garage door opener to the garage door.

Recent advancements in the development of limited range transmitters has allowed their incorporation into devices known as automatic garage door openers. These devices utilize a motor which imparts motion to a travelling member of one sort or the other which is attached to the garage door. Upon remote activation by a transmitter or a switch, the motor is energized and the garage door is opened or closed. These units have been perfected such that they are becoming a very common feature in use on garage doors.

The automatic garage door opener allows for opening and closing of the garage door without having to exit from a motor vehicle or the like which one was desirous of placing in or taking out of the garage. This is both a safety factor, protecting the occupants of the vehicle from exposing themselves to potential danger outside of their vehicle and the garage, and a convenience feature in inclement weather and the like.

While the automatic garage door opener has many positive features which are contributing significantly to its popularlity, these devices do not offer the security in locking a garage door which other, conventional locks, padlocks and the like, offer.

Most particular brands of automatic garage door openers offer a limited number of codes which the individual can choose to activate the automatic garage door opener to open and close the garage. While it is improbable that others could break these codes conveniently to open and close the garage door, other methods of entry into a closed garage equipped with an automatic garage door opener are possible.

Unless the user of the automatic garage door opener also incorporates a separate locking system, the only factor holding the garage door in a closed position is the linkage connecting the automatic garage door opener to the garage door. Depending upon the brand of automatic garage door opener, this linkage may or may not be strong enough to resist someone forcing the garage door open. Furthermore, the attachment of the automatic garage door opener to the ceiling of the garage can also be insufficient to prevent opening of the garage door by forcing the door open and effectively, in doing so, disattaching the automatic garage door opener from the ceiling of the garage. Furthermore, the automatic garage door openers commonly in use all attach to the top of the garage door. In those garage doors of the type wherein the door is pivotally mounted to the garage via linkages on its side, it is possible in wider garage doors, such as double garage doors and the like, to force up one of the bottom corners, distorting the garage door and allowing for entry of an unauthorized person into the garage.

In view of the above, it is evident that if the garage door is only held in the closed position by the automatic garage door opener, it is easily possible to penetrate the security of the garage by overcoming either the linkage mechanism of the automatic garage door opener, the attachment of the automatic garage door opener to the garage, or by manipulating the garage door at a point distal from where the automatic garage door opener attaches to the garage door. Presently, therefore, if security of a garage door equipped with an automatic garage door opener is to be at least on a par with garage doors not so equipped, auxiliary locks and the like must be used.

BRIEF DESCRIPTION OF THE INVENTION

In view of the above, it is a broad object of this invention to provide a locking device to be used in combination with an automatic garage door opener which adds an additional element of security to locking of the garage door over and above that presented by the automatic garage door opener itself. It is a further object of this invention to provide such a device which is easily adaptable for use with all makes and models of automatic garage door openers presently in existence and can be easily incorporated into new designs of automatic garage door openers. Furthermore, it is an object of this invention to provide such a device which, because of its construction and engineering, is both economical and of such a nature that malfunction of the device is negated.

These and other objects, as will become evident from the remainder of this specification are achieved in combination with an automatic garage door opener used for opening and closing a garage door a locking device which comprises: a housing means attached to said garage door; a bracket means attaching to the garage with which said garage door is associated, said bracket means attaching to said garage and said housing attaching to said garage door in positions such that when said garage is closed said housing means and said bracket means are located in association with one another; an element movably mounted on said housing to move between an unlocked position and a locked position, said automatic garage door opener attaching to said element and capable of moving said element between its unlocked and its locked position, said automatic garage door opener further capable of moving said garage door by imparting motion to said garage door, said motion imparted to said garage door imparted to said garage door by said automatic garage door opener interacting with said element which in turn interacts with said housing which in turn interacts with said garage door; said element in moving from its unlocked position to its locked position when said garage door is closed capable of engaging with said bracket means to lock said garage door against opening said garage door by an outside influence and when said garage door is in its closed position and when said element moves from its locked positon to its unlocked position said element disengaging from said bracket means allowing said garage door to be opened by said automatic garage door opener; element positioning means associated with said element and capable of holding said element in both its unlocked and locked position, said element positioning means interacting with said element such that when said garage door is open and said element is in its unlocked position movement imparted to said element and said garage door by said automatic garage door opener first moves the garage door from its open to its closed position and when said garage door is in its closed position subsequently moves said element from its unlocked to its locked position engaging said element with said bracket means and when said garage door is closed and said element is in its locked position engaged with said bracket means movement imparted to said element and said garage door by said automatic garage door opener first moves said element from its locked position to its unlocked position disengaging said element from said bracket means and subsequently moves said garage door from its closed to its open position.

In the preferred embodiment of the invention, the element is rotatably mounted on the housing and rotates on the housing between its locked and unlocked position. The element would include a locking means formed on the element and capable of engaging the bracket means when said garage door is closed and said element rotates on said housing from its unlocked to its locked position. The element would further include a transfer means capable of interacting with the housing when the element is in its unlocked position and transferring the force imparted to the element by the automatic garage door opener to the housing such that the force would be propagated to the garage door to open the garage door from its closed position to its open position. Preferredly, the element positioning means would comprise a biasing means capable of holding the element in both its unlocked and locked positions.

In the preferred use of the invention, the housing means would be attached along the top edge of the garage door, with the bracket means attached on the inside surface of the garage adjacent to the top edge of the garage door when the garage door is in a closed position.

In the preferred embodiment of the element and the housing, a portion of both the element and the housing would form a toggle, with the biasing means being present as a spring, linking the elements of the toggle such that when the toggle is over the center in one direction, the element would be in its locked position, and when the toggle was over center in the opposite direction, the element woud be in its unlocked position. A further portion of the element can be formed as the locking means with this further portion shaped as an arcuate projection on the element and movable with respect to the bracket means as the element moves in the housing between the unlocked and locked position. The arcuate shaped projection would fit into a hole located on the bracket means and when so engaged in the hole, lock the element to the bracket and thus lock the garage door to the garage.

In use in conjunction with the above described features of the invention, further remote locking means could be positioned either along the bottom or the side edges, or both the bottom and side edges of the garage door. These would be capable of engaging either the surface on which the garage rests, or the sides of the garage. These further remote locking means would include connecting means connecting the remote locking means to the element such that the remote locking means are activated and deactivated as the element moves between its locked and unlocked positions, respectively.

The preferred form of the remote locking means would comprise at least one remote bracket means and an elongated element means movably attached to the remote bracket means to move between an extended and retracted position. The connecting means would attach the elongated element means to the element such that the elongated element means moved in conjunction with movement of the element.

BRIEF DESCRIPTION OF THE DRAWINGS

This invention will be better understood when taken in conjunction with the drawings wherein.

Figure 1:
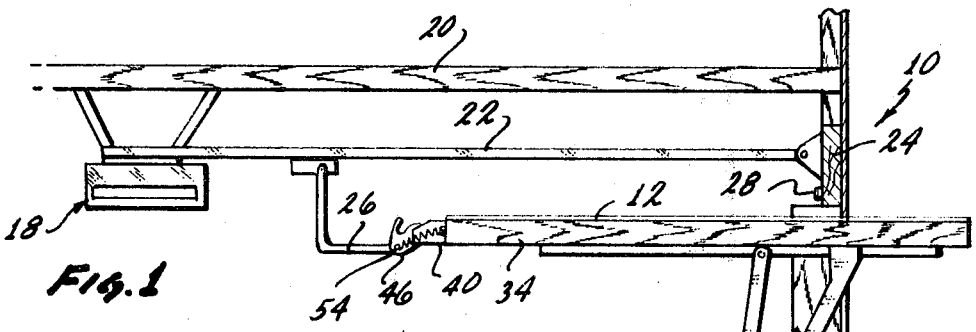
FIG. 1 is a side elevational view in partial section of a garage, a garage door, an automatic garage door opener and the locking device of the invention being utilized therein with the garage door being shown in an open configuration.

The invention described in this specification and illustrated in the drawings utilizes certain principles and/or concepts as are set forth and claimed in the claims appended to this specification. The invention is illustrated utilizing one embodiment of these principles and concepts. Those skilled in the mechanical arts will realize that these principles and concepts as set forth in the claims herein are capable of being expressed in a variety of embodiments differing from the exact illustrated embodiment utilized. For this reason this invention is to be construed as being limited only in the light of the claims and is not to be construed as being limited to the exact illustrated embodiment.

DETAILED DESCRIPTION OF THE INVENTION

In the FIGS., there are shown portions of a garage and portions of a garage door. Except where otherwise needed to indicate particular portions of these two structures, the garage will be generally indicated by the numeral 10 and the garage door by the numeral 12. These are of standard construction and can be of a variety of types. For use in illustating the invention, the garage door 12 shown is of the type which is hinged at its side utilizing standard, commercially available hinges 14 which include springs 16 biasing the door 12 upwardly against the weight of the door 12. Of course, two of the hinges 14 would be utilized on the door 12, one on the right side and one on the left side. For the purposes of illustration, only one of the hinges is seen in FIG. 1. Insofar as the hinge 14 does not form a portion of this invention and is, in fact, simply a commercial hinge, it has been deleted from FIGS. 2 and 5 in order to simplify the drawings and the understanding of the invention.

An automatic garage door opener 18 is located beneath the roof 20 of the garage 10. The automatic garage opener 18 is any one of a number of standard commmercially available units. It includes a track 22 appropropriately suspended between the automatic garage door opener 18 and the header 24 forming a portion of the wall of the garage 10. A traveller 26 moves horizontally on the track 22 under the influence of the automatic garage door opener 18. Normally, the traveller 26 would be linked directly to the garage door 12; however, with use of the invention herein, the traveller 26 is indirectly linked to the garage door 12 as hereinafter explained. In any event, the traveller 26 moves to the right and left horizontally in FIG. 1. Movement to the right would close the garage door 12, where movement to the left would open it.

Figure 2:
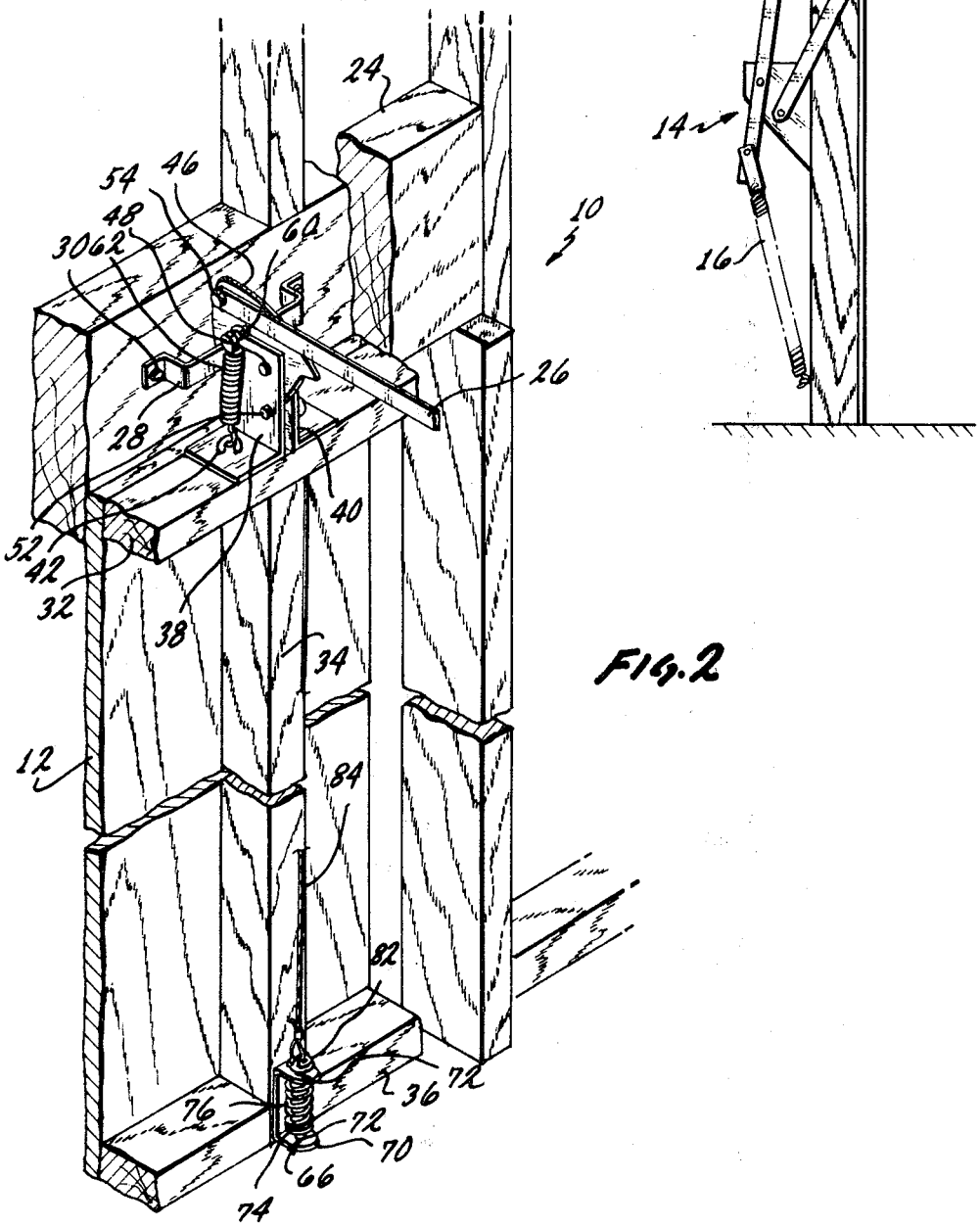
FIG. 2 is an oblique view in partial section showing a cutaway portion of the garage and garage door of FIG. 1 with the locking device of the invention attached thereto and seen in a locked configuration.

FIG. 2 illustrates the component parts of the invention which are utilized to lock the garage door 12 closed with respect to the garage 10. A bracket 28 is fixed to the header 24 using suitable lag bolts, collectively identified by the numeral 30. The door 12 includes the upper cross beam 32. This is appropriately attached to a plurality of vertical studs, such as the vertical stud 34, shown in FIG. 2. A bottom cross beam 36 is located beneath the vertical studs 34 to form the bottommost support for the door 12.

A left housing member 38 and a right housing member 40 are mounted to the top cross beam 32 utilizing appropriate fasteners such as J-bolts, collectively identified by the numeral 42. The J-bolts 42 go through the top cross beam 32 and are appropriately affixed thereto by a nut, collectively identified by the numeral 44, to fixedly hold the left and right housing members 38 and 40 to the top cross beam 32. The left and right housing members 38 and 40 are, in essence, "L" shaped members which preferredly are formed of a material such as a one-eighth inch plate steel or the like.

The left and right housing members 38 and 40 are located on the top cross beam 32 of the door 12 such that when the door 12 is closed with respect to the garage 10, the bracket 28 is positioned in proximity to these housings 38 and 40.

An element 46 is located between the left and right housings 38 and 40. The element 46 is pivotally mounted to these housings 38 and 40 via a nut and bolt 48 which serve as an axle, allowing for rotation of the element 46 with respect to the housings 38 and 40. A second nut and bolt 50 serves to maintain the housings 38 and 40 in line with respect to one another, as does a third nut and bolt 52. The third nut and bolt 52 however, serves an additional function, as will be outlined below.

The traveller 26 of the automatic garage door opener 18 is pivotally mounted to the element 46 via nut and bolt 54.

Figure 3:
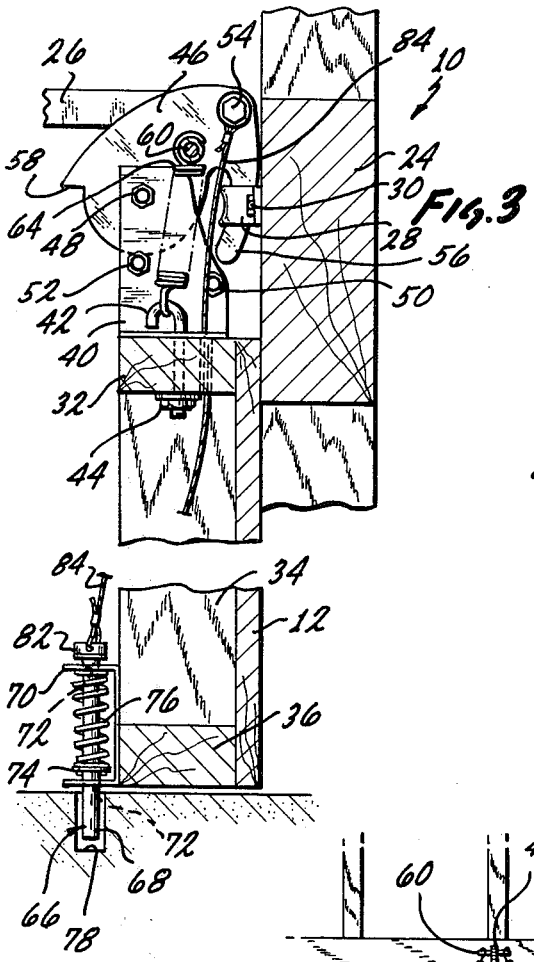
FIG. 3 is a side elevational view in partial section of certain components as seen in FIG. 2 showing these components in a locked configuration.
Figure 4:
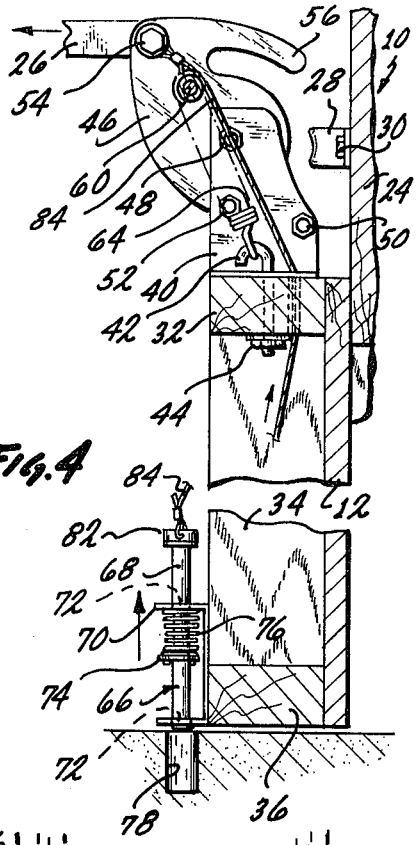
FIG. 4 is a side elevational view in sections similar to FIG. 4 with the exception that certain components of the invention are shown in an unlocked configuration.

In viewing FIGS. 3 and 4, it can be seen that the element 46 pivots about nut and bolt 48 as the traveller 26 moves back and forth under the influence of the automatic garage door opener 18. The element 46 is shaped to include an arcuate shaped projection 56. The arcuate shaped projection 56 is generally centered about the nut and bolt 48. As is evident from viewing FIG. 4, it is not a true circle; however, it is generally curved, at least for the most part, about a gross center of radius located at the nut and bolt 48.

It can be seen that when the traveller 26 is moved to the right, as in FIG. 3, rotation of the element 46 within the housings 38 and 40 push the arcuate shaped projection 56 downwardly, and if the garage door is closed, this locates the arcuate shaped projection 56 within the opening in the bracket 28 to fix the projection 56 within this opening and to fix the element 46 against the header 24. Contrary to this, when the traveller 26 moves to the left, as seen in FIG. 4, the element 46 rotates about the nut and bolt 48 to rotate the arcuate shaped projection 56 out of the opening formed in the bracket 28, bringing the projection 56 away from the header 24. In FIG. 3, when the element 46 is thus rotated clockwise about the nut and bolt 48, the element 46, the housings 38 and 40 and the door 12 are fixed with respect to the header 24. Contrary to this, in FIG. 4, when the element 46 is rotated counterclockwise, these components are no longer fixed with respect to the header 24 and thus neither is the door 12 fixed with respect to the garage 10 as far as movement of the door 12 from its open and closed position with respect to the garage 10 is concerned.

The element 46 includes a notch 58 located thereon. In FIG. 3 the notch 58 is seen to project outwardly to the left. However, in FIG. 4, it can be seen that the notch 58 has abutted against the nut and bolt 52, preventing further counterclockwise rotation of the element 46 about the nut and bolt 48. The significance of this is as follows.

When the door 12 is closed with respect to the garage 10, initial movement of the traveller 26 upon activation of the automatic garage door opener 18 causes the rotation of the element 46 with respect to the housings 38 and 40. This rotation would be counterclockwise, as seen in FIG. 3. This rotation is limited however, by engagement of the notch 58 with the nut and bolt 52, as seen in FIG. 4. When the notch 58 is so engaged with the nut and bolt 52, the element 46 no longer can rotate counterclockwise with respect to the housings 38 and 40. After engagement of the notch 58 with the nut and bolt 52, further movement of the traveller 26 to the left in FIG. 4 is communicated via the element 46 to the housings 38 and 40 and from the housings 38 and 40 to the door 12 to open the door. As such, it is evident that when the door 12 is locked by the location of the projection 56 within the bracket 28, as seen in FIG. 3, and the automatic garage door opener 18 is activated, the first motion imparted to the traveller 26 by the automatic garage door opener 18 results in unlocking of the element 46 from the bracket 28 by rotation of the element 46. After the element 46 has rotated until the notch 58 contacts the nut and bolt 52, further movement of the traveller 26 thus is communicated to the door 12 to open the door.

Figure 5:
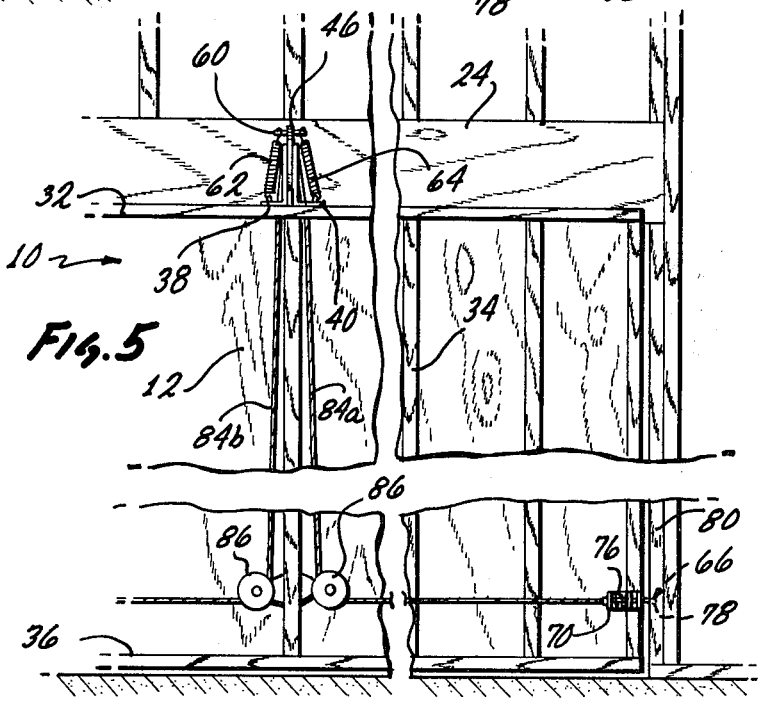
FIG. 5 is a back elevational view of the garage and garage door of FIG. 2 with an alternate embodiment of one of the components of the invention.

A rod 60 is located transversely through the element 46 and projects to the right and left of the element 46, as is evident in viewing FIG. 5 and FIG. 2. A left side spring 62 and a right side spring 64 extend from the J-bolts 42 upwardly to the respective sides of the rod 60. The springs 62 and 64 are chosen such that when the element 46 is in the location as seen in FIG. 3, a slight tension is imparted to the element 46 by the springs 62 and 64 pulling down on the rod 60. Further, when the element 46 is in the position as seen in FIG. 4, this tension within the springs 62 and 64 is maintained and is increased by elongation of the springs 62 and 64 to hold the element 46 in position such that the notch 58 is located against the nut and bolt 52. In moving between the positions of the element 46 seen in FIGS. 3 and 4, the spring moves from a position where it is on one side of the nut and bolt 48 in FIG. 3 and on the opposite side of the nut and bolt 48 in FIG. 4. Thus, when the element 46 is in a locked position, the spring is located with respect to the nut and bolt 48 such that it biases the projection 56 of the element 46 downwardly, and when the element 46 is in an unlocked position as in FIG. 4, the springs 62 and 64 bias the element 46 in the opposite way, such that the notch 58 is biased against the nut and bolt 52.

In essence, portions of the housings 38 and 40 and the element 46 form a toggle linkage, with the springs 62 and 64 bringing this toggle linkage off-center to one side of the nut and bolt 48 when the element 46 is in the locked position as in FIG. 3, and to the other side of the nut and bolt 48 when the element 46 is in the unlocked position as seen in FIG. 4. When the rod 60 and the nut and bolt 48 are directly aligned parallel with the springs 62 and 64, the portions of the element 46 and the housings 38 and 40 which are lined up in toggle, would be on dead center. Movement either to the right as seen in FIG. 3, or to the left as seen in FIG. 4 of this dead center alignment would cause the springs 62 and 64 to thus bias the element 46 either to the right in a clockwise manner as seen in FIG. 3 or to the left in a counterclockwise manner as seen in FIG. 4.

As noted above, when the door 12 is closed, and the projection 56 of the element 46 locks in the bracket 28, initial movement of the traveller 26 to the left under the influence of the automatic garage door opener 18 unlocks the element 46 from the bracket 28. In so unlocking the element 46 from the bracket 28, the springs 62 and 64 are stretched slightly and flipped over the center of the toggle located at nut and bolt 48. Once contact of the notch 58 with the nut and bolt 52 occurs, further movement of the traveller 26 then opens the garage door 12.

With the garage door 12 in an open position, activation of the automatic door opener 18 to close the garage door imparts movement to the element 46 via movement of the traveller 26 to the right. Because the element 46 is being held in its unlocked position with the notch 58 located against the nut and bolt 52 by the tension in the springs 62 and 64, initial movement of the traveller 26 does not cause rotation of the element 46 with respect to the housings 38 and 40 but causes movement of the door 12 from its open position to its closed position. When the door 12 is completely closed, such that it abutts against the header 24, it is refrained from further movement. At this time, continued movement of the traveller 26 is such that it overcomes the bias of the springs 62 and 64 and causes rotation of the element 46 about its center of rotation located at the nut and bolt 48. This rotation then moves the element 46 from its unlocked position to its locked position such that the projection 56 engages the bracket 28 to lock the element 46 with respect to the bracket 28.

When the element 46 is locked with respect to the bracket 28, if the door 12 is pushed against by an outside influence, in an attempt to open the door 12, movement of the door 12 results in further clockwise rotation of the element 46 as seen in FIG. 3, which only tends to further lock the element 46 with respect to the bracket 28. Since, in FIG. 3, the door 12 would have to move upwardly and to the left if it is to be opened, it is evident from viewing FIG. 3 that, because of the arcuate nature of the projection 56 and the rotary mounting of the element 46 on the housings 38 and 40, that such movement serves to further engage the projection 56 against the bracket 28. Once the element 46 is in its locked position, the top of the door 12 cannot be moved away from the header 24 by any forces imparted to the door 12 from the outside of the garage 10. It is only upon movement of the traveller 26 to rotate the element 46 from its locked to its unlocked position that it becomes possible to move the top of the door 12 away from the header 24.

In order to secure the bottom and/or the sides of the door 12 against distortion of the door 12, allowing for someone to crawl past the bottom corners of the door 12 and gain illegal access to the garage 10, the locking device composed of the element 46, its associated housings 38 and 40 and the bracket 28 can be augmented by the use of one or more remote locking members, collectively identified by the numeral 66 in the drawings. The remote locking members 66 can be located either along the bottom of the door 12, as is depicted in FIGS. 2, 3 and 4, or they can be located along the side of the door 12, as is depicted in FIG. 5.

The remote locking members 66, whether they are located on the bottom or the sides of the door 12, are constructed identically and include an elongated rod 68 which is mounted in a "U" shaped bracket 70. The "U" shaped bracket 70 has holes collectively identified by the numeral 72 in each of its arms, allowing for movement of the rod 68 with respect to the bracket 70. As is best seen in FIGS. 3 and 4, a flange 74 is fixedly attached to the rod 68 and moves with it. A spring 76 is located around the rod 68 between one of the arms of the bracket 70 and the flange 74. The bias of the spring 76 pushes against the flange 74, tending to push the rod 68 outwardly from the bracket 70, as is seen in FIG. 3.

A hole, such as the hole 78 shown in FIGS. 3 and 4, is located either in the foundation on which the garage 10 is supported, or in the side framing of the opening of the garage 10. Thus, in FIG. 5, the appropriate hole 78 would be located in the side framing member 80 located along the edge of the opening for the door 12. In any event, under the bias of the spring 76, the rod 68 is pushed outwardly from the bracket 70 such that it can be located in the hole 78.

The top of the rod 68 is flared, forming a head 82. The head 82 limits the movement of the rod 68 within the bracket 70 under the influence of the spring 76 and serves as a connecting point for a cable 84. The cable 84 runs from the head 82 of the rod 68 upwardly through one or the other of the housing members 38 or 40 and it attaches to the nut and bolt 54 whereby the traveller 26 is attached to the element 46. Of course, the cable 84 is appropriately passed through holes formed in the lumber of the door 12, such as the top cross beam 32 and/or any other members used in constructing the door 12.

When the element 46 is in its locked position, the bias of the spring 76 is such that it stretches the cable 84 and allows for insertion of the rod 68 into the hole 78. When the element 46 is rotated to its unlocked position, the upper portion of the cable 84 is stretched upwardly with respect to the housings 38 or 40, pulling the cable taut, and moving the rod 68 within the bracket 70 against the bias of the spring 76. This moves the rod 68 out of the hole 78, thus releasing the locking attachment of the remote locking member from either the foundation of the garage 10 or the framing member 80.

In FIG. 5, two cables 84 are shown. These pass around pulleys, collectively identified by the numeral 86, before feeding to remote locking members 66, as is exemplified in that FIG. by the one on the right hand side. In the arrangement as seen in FIG. 5, one of the cables, **84*a*, would pass through the right housing member 40, attaching to the right hand side of the nut and bolt 54, whereas the other of the cables, 84*b*, would pass through the left housing member 38 and attach to the left hand side of the nut and bolt 54. In any event, the use of the remote locking members 66 allow for fixing of the bottom and/or the sides of the garage door 12 to of the automatic garage door opener 18. Normally, the traveller 26 would be linked directly to the garage door 12; however, with use of the invention herein, the traveller 26 is indirectly linked to the garage door 12 as hereinafter explained. In any event, the traveller 26 moves to the right and left horizontally in FIG. 1. Movement to the right would close the garage door 12**, where movement to the left would open it.

FIG. 2 illustrates the component parts of the invention which are utilized to lock the garage door 12 closed with respect to the garage 10. A bracket 28 is fixed to the header 24 using suitable lag bolts, collectively identified by the numeral 30. The door 12 includes the upper cross beam 32. This is appropriately attached to a plurality of vertical studs, such as the vertical stud 34, shown in FIG. 2. A bottom cross beam 36 is located beneath the vertical studs 34 to form the bottommost support for the door 12.

A left housing member 38 and a right housing member 40 are mounted to the top cross beam 32 utilizing appropriate fasteners such as J-bolts, collectively identified by the numeral 42. The J-bolts 42 go through the top cross beam 32 and are appropriately affixed thereto by a nut, collectively identified by the numeral 44, to fixedly hold the left and right housing members 38 and 40 to the top cross beam 32. The left and right housing members 38 and 40 are, in essence, "L" shaped members which preferredly are formed of a material such as a one-eighth inch plate steel or the like.

The left and right housing members 38 and 40 are located on the top cross beam 32 of the door 12 such that when the door 12 is closed with respect to the garage 10, the bracket 28 is positioned in proximity to these housings 38 and 40.

An element 46 is located between the left and right housings 38 and 40. The element 46 is pivotally mounted to these housings 38 and 40 via a nut and bolt 48 which serve as an axle, allowing for rotation of the element 46 with respect to the housings 38 and 40. A second nut and bolt 50 serves to maintain the housings 38 and 40 in line with respect to one another, as does a third nut and bolt 52. The third nut and bolt 52 however, serves an additional function, as will be outlined below.

The traveller 26 of the automatic garage door opener 18 is pivotally mounted to the element 46 via nut and bolt 54.

In viewing FIGS. 3 and 4, it can be seen that the element 46 pivots about nut and bolt 48 as the traveller 26 moves back and forth under the influence of the automatic garage door opener 18. The element 46 is shaped to include an arcuate shaped projection 56. The arcuate shaped projection 56 is generally centered about the nut and bolt 48. As is evident from viewing FIG. 4, it is not a true circle; however, it is generally curved, at least for the most part, about a gross center of radius located at the nut and bolt 48.

It can be seen that when the traveller 26 is moved to the right, as in FIG. 3, rotation of the element 46 within the housings 38 and 40 push the arcuate shaped projection 56 downwardly, and if the garage door is closed, this locates the arcuate shaped projection 56 within the opening in the bracket 28 to fix the projection 56 within this opening and to fix the element 46 against the header 24. Contrary to this, when the traveller 26 moves to the left, as seen in FIG. 4, the element 46 rotates about the nut and bolt 48 to rotate the arcuate shaped projection 56 out of the opening formed in the bracket 28, bringing the projection 56 away from the header 24. In FIG. 3, when the element 46 is thus rotated clockwise about the nut and bolt 48, the element 46, the housings 38 and 40 and the door 12 are fixed with respect to the header 24. Contrary to this, in FIG. 4, when the element 46 is rotated counterclockwise, these components are no longer fixed with respect to the header 24 and thus neither is the door 12 fixed with respect to the garage 10 as far as movement of the door 12 from its open and closed position with respect to the garage 10 is concerned.

The element 46 includes a notch 58 located thereon. In FIG. 3 the notch 58 is seen to project outwardly to the left. However, in FIG. 4, it can be seen that the notch 58 has abutted against the nut and bolt 52, preventing further counterclockwise rotation of the element 46 about the nut and bolt 48. The significance of this is as follows.

When the door 12 is closed with respect to the garage 10, initial movement of the traveller 26 upon activation of the automatic garage door opener 18 causes the rotation of the element 46 with respect to the housings 38 and 40. This rotation would be counterclockwise, as seen in FIG. 3. This rotation is limited however, by engagement of the notch 58 with the nut and bolt 52, as seen in FIG. 4. When the notch 58 is so engaged with the nut and bolt 52, the element 46 no longer can rotate counterclockwise with respect to the housings 38 and 40. After engagement of the notch 58 with the nut and bolt 52, further movement of the traveller 26 to the left in FIG. 4 is communicated via the element 46 to the housings 38 and 40 and from the housings 38 and 40 to the door 12 to open the door. As such, it is evident that when the door 12 is locked by the location of the projection 56 within the bracket 28, as seen in FIG. 3, and the automatic garage door opener 18 is activated, the first motion imparted to the traveller 26 by the automatic garage door opener 18 results in unlocking of the element 46 from the bracket 28 by rotation of the element 46. After the element 46 has rotated until the notch 58 contacts the nut and bolt 52, further movement of the traveller 26 thus is communicated to the door 12 to open the door.

A rod 60 is located transversely through the element 46 and projects to the right and left of the element 46, as is evident in viewing FIG. 5 and FIG. 2. A left side spring 62 and a right side spring 64 extend from the J-bolts 42 upwardly to the respective sides of the rod 60. The springs 62 and 64 are chosen such that when the element 46 is in the location as seen in FIG. 3, a slight tension is imparted to the element 46 by the springs 62 and 64 pulling down on the rod 60. Further, when the element 46 is in the position as seen in FIG. 4, this tension within the springs 62 and 64 is maintained and is increased by elongation of the springs 62 and 64 to hold the element 46 in position such that the notch 58 is located against the nut and bolt 52. In moving between the positions of the element 46 seen in FIGS. 3 and 4, the spring moves from a position where it is on one side of the nut and bolt 48 in FIG. 3 and on the opposite side of the nut and bolt 48 in FIG. 4. Thus, when the element 46 is in a locked position, the spring is located with respect to the nut and bolt 48 such that it biases the projection 56 of the element 46 downwardly, and when the element 46 is in an unlocked position as in FIG. 4, the springs 62 and 64 bias the element 46 in the opposite way, such that the notch 58 is biased against the nut and bolt 52.

In essence, portions of the housings 38 and 40 and the element 46 form a toggle linkage, with the springs 62 and 64 bringing this toggle linkage off-center to one side of the nut and bolt 48 when the element 46 is in the locked position as in FIG. 3, and to the other side of the nut and bolt 48 when the element 46 is in the unlocked position as seen in FIG. 4. When the rod 60 and the nut and bolt 48 are directly aligned parallel with the springs 62 and 64, the portions of the element 46 and the housings 38 and 40 which are lined up in toggle, would be on dead center. Movement either to the right as seen in FIG. 3, or to the left as seen in FIG. 4 of this dead center alignment would cause the springs 62 and 64 to thus bias the element 46 either to the right in a clockwise manner as seen in FIG. 3 or to the left in a counterclockwise manner as seen in FIG. 4.

As noted above, when the door 12 is closed, and the projection 56 of the element 46 locks in the bracket 28, initial movement of the traveller 26 to the left under the influence of the automatic garage door opener 18 unlocks the element 46 from the bracket 28. In so unlocking the element 46 from the bracket 28, the springs 62 and 64 are stretched slightly and flipped over the center of the toggle located at nut and bolt 48. Once contact of the notch 58 with the nut and bolt 52 occurs, further movement of the traveller 26 then opens the garage door 12.

With the garage door 12 in an open position, activation of the automatic door opener 18 to close the garage door imparts movement to the element 46 via movement of the traveller 26 to the right. Because the element 46 is being held in its unlocked position with the notch 58 located against the nut and bolt 52 by the tension in the springs 62 and 64, initial movement of the traveller 26 does not cause rotation of the element 46 with respect to the housings 38 and 40 but causes movement of the door 12 from its open position to its closed position. When the door 12 is completely closed, such that it abutts against the header 24, it is refrained from further movement. At this time, continued movement of the traveller 26 is such that it overcomes the bias of the springs 62 and 64 and causes rotation of the element 46 about its center of rotation located at the nut and bolt 48. This rotation then moves the element 46 from its unlocked position to its locked position such that the projection 56 engages the bracket 28 to lock the element 46 with respect to the bracket 28.

When the element 46 is locked with respect to the bracket 28, if the door 12 is pushed against by an outside influence, in an attempt to open the door 12, movement of the door 12 results in further clockwise rotation of the element 46 as seen in FIG. 3, which only tends to further lock the element 46 with respect to the bracket 28. Since, in FIG. 3, the door 12 would have to move upwardly and to the left if it is to be opened, it is evident from viewing FIG. 3 that, because of the arcuate nature of the projection 56 and the rotary mounting of the element 46 on the housings 38 and 40, that such movement serves to further engage the projection 56 against the bracket 28. Once the element 46 is in its locked position, the top of the door 12 cannot be moved away from the header 24 by any forces imparted to the door 12 from the outside of the garage 10. It is only upon movement of the traveller 26 to rotate the element 46 from its locked to its unlocked position that it becomes possible to move the top of the door 12 away from the header 24.

In order to secure the bottom and/or the sides of the door 12 against distortion of the door 12, allowing for someone to crawl past the bottom corners of the door 12 and gain illegal access to the garage 10, the locking device composed of the element 46, its associated housings 38 and 40 and the bracket 28 can be augmented by the use of one or more remote locking members, collectively identified by the numeral 66 in the drawings. The remote locking members 66 can be located either along the bottom of the door 12, as is depicted in FIGS. 2, 3 and 4, or they can be located along the side of the door 12, as is depicted in FIG. 5.

The remote locking members 66, whether they are located on the bottom or the sides of the door 12, are constructed identically and include an elongated rod 68 which is mounted in a "U" shaped bracket 70. The "U" shaped bracket 70 has holes collectively identified by the numeral 72 in each of its arms, allowing for movement of the rod 68 with respect to the bracket 70. As is best seen in FIGS. 3 and 4, a flange 74 is fixedly attached to the rod 68 and moves with it. A spring 76 is located around the rod 68 between one of the arms of the bracket 70 and the flange 74. The bias of the spring 76 pushes against the flange 74, tending to push the rod 68 outwardly from the bracket 70, as is seen in FIG. 3.

A hole, such as the hole 78 shown in FIGS. 3 and 4, is located either in the foundation on which the garage 10 is supported, or in the side framing of the opening of the garage 10. Thus, in FIG. 5, the appropriate hole 78 would be located in the side framing member 80 located along the edge of the opening for the door 12. In any event, under the bias of the spring 76, the rod 68 is pushed outwardly from the bracket 70 such that it can be located in the hole 78.

The top of the rod 68 is flared, forming a head 82. The head 82 limits the movement of the rod 68 within the bracket 70 under the influence of the spring 76 and serves as a connecting point for a cable 84. The cable 84 runs from the head 82 of the rod 68 upwardly through one or the other of the housing members 38 or 40 and it attaches to the nut and bolt 54 whereby the traveller 26 is attached to the element 46. Of course, the cable 84 is appropriately passed through holes formed in the lumber of the door 12, such as the top cross beam 32 and/or any other members used in constructing the door 12.

When the element 46 is in its locked position, the bias of the spring 76 is such that it stretches the cable 84 and allows for insertion of the rod 68 into the hole 78. When the element 46 is rotated to its unlocked position, the upper portion of the cable 84 is stretched upwardly with respect to the housings 38 or 40, pulling the cable taut, and moving the rod 68 within the bracket 70 against the bias of the spring 76. This moves the rod 68 out of the hole 78, thus releasing the locking attachment of the remote locking member from either the foundation of the garage 10 or the framing member 80.

In FIG. 5, two cables 84 are shown. These pass around pulleys, collectively identified by the numeral 86, before feeding to remote locking members 66, as is exemplified in that FIG. by the one on the right hand side. In the arrangement as seen in FIG. 5, one of the cables, **84*a*, would pass through the right housing member 40, attaching to the right hand side of the nut and bolt 54, whereas the other of the cables, 84*b*, would pass through the left housing member 38 and attach to the left hand side of the nut and bolt 54. In any event, the use of the remote locking members 66 allow for fixing of the bottom and/or the sides of the garage door 12 to either the foundation of the garage 10 or to the side framing members 80 of the garage 10**.

As illustrated in the drawings herein, the garage door 12 is of the type wherein it is supported against the garage 10 by the two side hinge members 14. The invention described herein is also useful on other types of garage doors, including commercial overhead doors which are broken into horizontal segments and move on rollers of tracks which run first vertically up the sides of the garage and then horizontally overhead. The upper section of such garage doors, just prior to when the garage door is closed, move downwardly, accompanied by a horizontal movement. Such horizontal movement is sufficient for locking of an element 46 against the bracket 28. Thus the exact same components as illustrated herein in the drawings would be utilized, the only difference being that the garage door 12 would be slightly modified, and in place of the hinges 14, other commercially available suspending mechanisms would be utilized.

While for the purposes of illustrating the invention herein a garage door 12 has been utilized, other closures such as tiltable windows and the like would be susceptible to being open and closed and being locked utilizing the invention herein and an appropriate automatic opener equivalent to the garage door opener 18.

I claim:

1. In combination with an automatic garage door opener used for opening and closing a garage door a locking device which comprises:

a housing means attaching to said garage door;

a bracket means attaching to the garage with which said garage door is associated, said bracket means attaching to said garage and said housing attaching to said garage door in positions such that when said garage is closed said housing means and said bracket means are located in association with one another;

an element rotatably mounted on said housing to rotate on said housing between an unlocked position and a locked position, sad automatic garage door opener directly attaching to said element and capable of moving said element betwen its unlocked and its locked position, said automatic garage door opener further capable of moving said garage door by imparting motion to said garage door, said motion imparted to said garage door for both opening and closing said garage door by said automatic garage door opener interacting with said element which in turn interacts with said housing which in turn interacts with said garage door;

said element in moving from its unlocked position to its locked position when said garage door is closed capable of engaging with said bracket means to lock said garage door against opening said garage door by an outside influence and when said garage door is in its closed position and said element moves from its locked position to its unlocked position said element disengaging from said bracket means allowing said garage door to be opened by said automatic garage door opener;

element positioning means associated with said element and capable of holding said element in both its unlocked and locked position, said element positioning means interactng with said element such that when said garage door is open and said element is in its unlocked position movement imparted to said element and said garage door by said automatic garage door opener moves said garage door from its open to its closed position and when said garage door is in its closed position subsequently moves said element from its unlocked to its locked position engaging said element with said bracket means and when said garage door is closed and said element is in its locked position engaged with said bracket means movement imparted to said garage door by said automatic garage door opener first moves said element from its locked position to its unlocked position disengaging said element from said bracket means and subsequently moves said garage door from its closed to its open position.

2. The locking device of claim 1 wherein:

said element including locking means formed on said element and capable of engaging with said bracket means when said garage door is closed and said element rotates on said housing from its unlocked position to its locked position.

3. The locking device of claim 2 wherein:

said element further includes transfer means, said transfer means capable of interacting with said housing when said element is in its unlocked position and transferring force imparted to said element by said automatic garage door opener to said housing to move said garage door from its closed position to its open position.

4. In combination with an automatic garage door opener used for opening and closing a garage door a locking device which comprises:

a housing means attaching to said garage door;

a bracket means attaching to the garage with which said garage door is associated, said bracket means attaching to said garage and said housing attaching to said garage door in positions such that when said garage is closed said housing means and said bracket means are located in association with one another;

an element movably mounted on said housing to move between an unlocked position and a locked position, said automatic garage door opener attaching to said element and capable of moving said element between its unlocked and its locked position, said automatic garage door opener further capable of moving said garage door by imparting motion to said garage door, said motion imparted to said garage door imparted to said garage door by said automatic garage door opener interacting with said element which in turn interacts with said housing which in turn interacts with said garage door;

said element in moving from its unlocked position to its locked position when said garage door is closed capable of engaging with said bracket means to lock said garage door against opening said garage door by an outside influence and when said garage door is in its closed position and said element moves from its locked position to its unlocked position said element disengaging from said bracket means allowing said garage door to be opened by said automatic garage door opener;

element positioning means associated with said element and capable of holding said element in both its unlocked and locked position, said element positioning means interacting with said element such that when said garage door is open and said element is in its unlocked position movement imparted to said element and said garage door by said automatic garage door opener moves said garage door from its open to its closed position and when said garage door is in its closed position subsequently moves said element from its unlocked to its locked position engaging said element with said bracket means and when said garage door is closed and said element is in its locked position engaged with said bracket means movement imparted to said garage door by said automatic garage door opener first moves said element from its locked position to its unlocked position disengaging said element from said bracket means and subsequently moves said garage door from its closed to its open position;

said element positioning means comprises a biasing means capable of holding said element in both its unlocked and locked positions.

5. The locking device of claim 4 wherein:

said housing means is attached along the top edge of said garage door and said bracket means is attached on an inside surface of said garage adjacent to said top edge of said garage door when said garage door is in its closed position.

6. The locking device of claim 5 further including:

remote locking means positioned along at least one of the bottom edge or the side edges of said garage door and capable of engaging one of said garage or the surface on which said garage rests;

said remote locking means including connecting means connecting said remote locking means to said element such that said remote locking means is activated and deactivated as said element moves between its locked and unlocked positions;

said remote locking means capable of interacting with said one of said garage to the surface on which said garage rests to further lock said bottom edge or said side edges of said garage door to said one of said garage or the surface on which said garage rests when said garage door is closed and said element is in its locked position.

7. The locking device of claim 6 wherein:

said remote locking means comprises at least one remote bracket means and an elongated means movably attached to said remote bracket means to move between an extended position and a retracted position;

said connecting means attaching to said elongated element means moving said elongated element means between said extended and said retracted position such that when said elongated element means is in said extended position said elongated element means is capable of engaging said garage or the surface on which said garage rests and when said elongated element is retracted said elongated element means is incapable of engaging said garage or the surface on which said garage rests.

8. The locking device of claim 7 wherein:

said remote locking means further includes biasing means biasing said elongated element means towards said engaged position;

said connecting means comprising a cable attaching between said element and said elongated element means and moving said elongated element means against the bias of said element biasing means when said elongated element means is in said retracted position.

9. In combination with an automatic garage door opener used for opening and closing a garage door a locking device which comprises:

a housing means attaching to said garage door;

a bracket means attaching to the garage with which said garage door is associated, said bracket means attaching to said garage and said housing attaching to said garage door in positions such that when said garage is closed said housing means and said bracket means are located in association with one another;

an element movably mounted on said housing to move between an unlocked position and a locked position, said automatic garage door opener attaching to said element and capable of moving said element between its unlocked and its locked position, said automatic garage door opener further capable of moving said garage door by imparting motion to said garage door, said motion imparted to said garage door imparted to said garage door by said automatic garage door opener interacting with said element which in turn interacts with said housing which in turn interacts with said garage door;

said element in moving from its unlocked position to its locked position when said garage door is closed capable of engaging with said bracket means to lock said garage door against opening said garage door by an outside influence and when said garage door is in its closed position and said element moves from its locked position to its unlocked position said element disengaging from said bracket means allowing said garage door to be opened by said automatic garage door opener;

element positioning means associated with said element and capable of holding said element in both its unlocked and locked position, said element positioning means interacting with said element such that when said garage door is open and said element is in its unlocked position movement imparted to said element and said garage door by said automatic garage door opener moves said garage door from its open to its closed position and when said garage door is in its closed position subsequently moves said element from its unlocked t its locked position engaging said element with said bracket means and when said garage door is closed and said element is in its locked position engaged with said bracket means movement imparted to said garage door by said automatic garage door opener first moves said element from its locked position to its unlocked position disengaging said element from said bracket means and subsequently moves said garage door from its closed to its open position;

said element is rotatably mounted in said housing and rotates on said housing between its locked and unlocked positions;

said element including locking means formed on said element and capable of engaging with said bracket means when said garage door is closed and said element rotates on said housing from its unlocked position to its locked position;

said element further includes transfer means, said transfer means capable of interacting with said housing when said element is in its unlocked position and transferring force imparted to said element by said automatic garage door opener to said housing to move said garage door from its closed position to its open position;

said element positioning means comprises a biasing means capable of holding said element in both its unlocked and locked positions;

said housing means is attached along the top edge of said garage door and said bracket means is attached on an inside surface of said garage adjacent to said top edge of said garage door when said garage door is in its closed position.

10. The locking device of claim 9 wherein:

said biasing means comprises a spring means attaching between said housing and said element;

at least a portion of said element and at least a portion of said housing forming a toggle with said spring means biasing said toggle over center in one direction when said element is in its locked position and biasing said toggle over center in the other direction when said element is in its unlocked position.

11. The locking device of claim 10 wherein:

said locking means comprises an arcuately shaped projection on said element;

said bracket means comprises a bracket having an opening;

said arcuately shaped projection fitting into said opening in said bracket means when said element engages said bracket means and arcuately withdrawing from said opening in said bracket when said element is disengaged from said bracket means.

12. A locking device for a closure which is movable between an open position and a closed position with respect to a structure by an appliance associated with the closure which comprises:

an engageable means attaching to said structure;

a housing means attaching to said closure;

an engaging means movably mounted on said housing means to move between a locked position and an unlocked position, said engaging means being moved between said locked position and said unlocked position by said appliance;

said engaging means located on said housing means on said closure and said engageable means located on said structure in positions such that when said closure is in said closed position with respect to said structure said engaging means and said engageable means are located proximal to each other, when said engaging means and said engageable means are located proximal to each other and said engaging means moves from said unlocked position to said locked position said engaging means engaging said engageable means to fixedly hold said engaging means with said engageable means;

governing means operatively associated with both said engaging means and said housing means and capable of maintaining said engaging means in both said locked and said unlocked positions;

said governing means including a spring means attaching between said housing and said engaging means;

at least a portion of said engaging means and at least a portion of said housing forming a toggle with said spring means biasing said toggle over center in one direction when said engaging means in is its locked position and biasing said toggle over center in the other direction when said engaging means is in its unlocked position;

said appliance capable of transferring movement under the influence of said governing means through said engaging means to said closure to move said closure between said open and said closed positions, when said closure is in said open position and said engaging means is in said unlocked position said governing means governing transfer of movement from said appliance to said engaging means such that said movement first moves said closure from said open to said closed position and subsequent movement then moves said engaging means from said unlocked position to said locked position engaging said engaging means with said engageable means to lock said closure in said closed position and when said closure is in said closed position and said engaging means is in said locked position in engagement with said engageable means said governing means governing movement imparted to said engaging means by aid appliance such that the first of said movement moves said engaging means from said locked position to said unlocked position disengaging said engaging means with said engageable means and subsequent movement moves said closure from said closed position to said open position.

* * * * *

UNITED STATES PATENT AND TRADEMARK OFFICE

CERTIFICATE OF CORRECTION

PATENT NO. : 4,442,631

DATED : APRIL 17, 1984

INVENTOR(S) : HARVEY L. WEBER

It is certified that error appears in the above-identified patent and that said Letters Patent is hereby corrected as shown below:

Column 9, line 41 "sad" should be --said--.
Column 9, line 65 "interactng" should be --interacting--.
Column 11, line 33 "to" should be --or--.
Column 12, line 41 "t" should be --to--.
Column 12, line 51 "in" should read --on-.
Column 14, line 37 "aid" should be --said--.

Signed and Sealed this

*Eleventh* Day of *June 1985*

[SEAL]

*Attest:*

DONALD J. QUIGG

*Attesting Officer* *Acting Commissioner of Patents and Trademarks*